United States Patent [19]

Young

[11] Patent Number: 4,878,584

[45] Date of Patent: Nov. 7, 1989

[54] ARTICLE HOLDER AND SELECTOR

[76] Inventor: Elbert J. Young, 1025 N. Prospect, Liberal, Kans. 67901

[21] Appl. No.: 350,407

[22] Filed: May 11, 1989

[51] Int. Cl.[4] ..... A47F 7/00

[52] U.S. Cl. ..... 211/59.1; 211/181

[58] Field of Search ..... 211/59.1, 49.1, 54.1, 211/57.1, 181, 119, 13

*Primary Examiner*—Sarah A. Lechok

*Attorney, Agent, or Firm*—Litman, McMahon & Brown

[57] ABSTRACT

A holding and selecting device for articles having central openings includes two configurations: one for the storing and transporting of articles and a second which allows a user to select and remove a particular article without having to remove other articles from the holder. The device includes a primary elongate holder and a secondary elongate holder. A user may select a particular item for removal from the device by connecting the two holders and slidably transferring a portion of the articles from the primary holder to the secondary holder until the selected article is reached. The holder may then be disconnected at the point of connection between the primary and secondary holder and the selected article removed.

14 Claims, 1 Drawing Sheet

ARTICLE HOLDER AND SELECTOR

BACKGROUND OF THE INVENTION

This invention relates to holders for articles (such as nuts, washers, pipe fittings and the like) having openings therethrough. In particular, the invention relates to holders that allow a user to select and remove a chosen article from a plurality of different articles that are held by the holder without having to remove other articles from the holder. Many conventional article holders do not allow a user to remove a particular article while leaving the unwanted articles on the holder. In particular, most having an elongate shaft or wire upon which articles are impaled, require that all articles ahead of desired article be physically removed from the device and then the unwanted article must be individually restrung or reimpaled on the holder.

It is often desirable for elongate article holders to be relatively long to allow for a sufficient number of articles to be held to allow for reasonable article selection. This requires a relatively long device to hold several articles and to provide enough space to move the articles to a certain point for removal. Long holders may be awkward to use or have an unwieldy shape making it difficult for a user to store or transport such holders. Therefore, it is also desirable to have a holder having a relatively compact shape that can be stored and carried easily.

SUMMARY OF THE INVENTION

The present invention comprises a device for holding a plurality of articles that have an opening therethrough and allowing a user to select a particular article for removal without having to remove from the holder and then replace at least some of the remaining articles. The device includes an elongate strip or wire adapted to pass through an opening and thereby captively impale each article to be held by the device.

The device includes a primary holder rotatably attached by a hinge mechanism to a secondary holder. The primary and secondary holders each include an elongate loop having a first storing or closed position and a second article selecting position relative to each other. The primary and secondary holders are separated and held in the closed position by a closure member.

Articles are placed on the primary holder by inserting the primary holder through the opening of each article for storage and transport. The secondary holder is usually kept empty during storage and transport. When a user wishes to remove a particular or selected article from the device, the primary and secondary holders are freed from the closure member and one end of the primary holder is connected to one end of the secondary holder, so as to form a continuous loop therebetween. The articles may then be slidably transferred sequentially from the primary holder to the secondary holder until the selected article is reached. The primary holder is then disconnected from the secondary holder and the selected article may be removed from the device.

OBJECTS OF THE INVENTION

Therefore, the objects of the invention are: to provide a device for holding and selecting articles that have openings therethrough so that a particular article out of a large number of such articles may be removed from the device without having to remove and thereafter replace any of the other articles from the device; to provide such a device which can be simply manufactured by bending or otherwise forming two lengths of formable, yet shape resilient (once formed) rod or wire into the configuration of the invention; to provide such a device that includes a closure that will adequately secure the articles on the holder for storage and transport; to provide such a device of a suitable size and shape so that the device is convenient to use, store and transport from one location to another; to provide such a device which can be easily sized for the size of the articles to be stored; and to provide such a device which is relatively inexpensive to make, easy to use and particularly well adapted for the intended purpose thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

Figure 1:
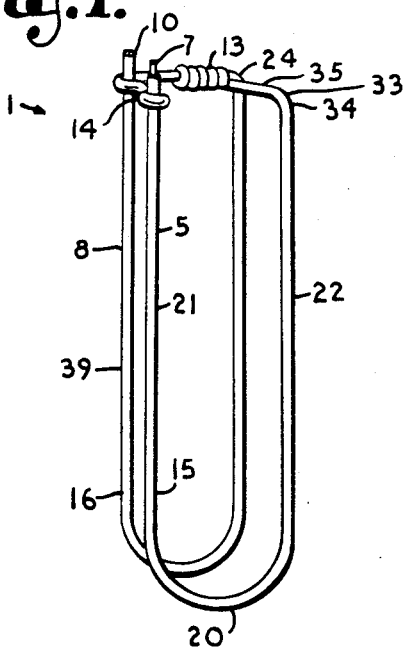
FIG. 1 is a perspective view of a holding and selecting device in accordance with the present invention in a closed position used for storage and transport of articles.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in the disclosed embodiment of the present invention:

FIGS. 1 through 4 illustrate an article holder and selector device in accordance with the present invention, generally designated by the reference numeral 1. The device includes a primary holder 5 having a connectable end 7, a secondary holder 8 having a connectable end 10, hinge means, such as illustrated hinge mechanism 13, rotatably connecting the primary holder 5 to the secondary holder 8, and closure means, such as illustrated closure member 14, for securing the primary holder 5 and the secondary holder 8 in a closed configuration used for storing and transporting articles.

When the primary holder 5 and the secondary holder 8 are secured in the closed position thereof (FIG. 1) by closure member 14, each holder 5 and 8 includes an elongate member such as the illustrated U-shaped loops 15 and 16 respectively in spaced relationship to one another. The loops 15 and 16, when in the closed position, are generally parallel aligned but substantially spaced such that articles 19 (see FIG. 4) on the loop 15 are not interferingly engaged by the loop 16.

The loops 15 and 16 are preferably constructed of a shape retaining, but somewhat resilient material such as stainless steel wire, metal or plastic rod, polyvinylchloride pipe for larger items, or the like; however, the size of both length and diameter of the loops 15 and 16 can be varied to be usable with different sized articles 19. When used for small articles 19 such as nuts, washers, etc. with center bores of less than one-half inch, a relatively small wire is utilizied; whereas, when the invention is used for larger items such as four inch plastic sewer pipe fittings, onehalf inch plastic pipe or the like can be utilized to construct the loops 15 and 16.

Figure 2:
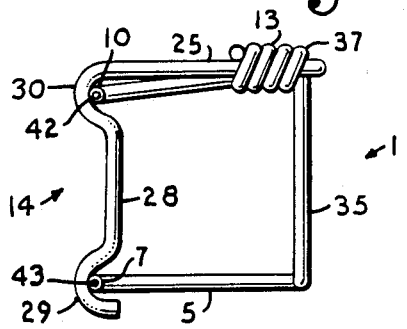
FIG. 2 is an enlarged top plan view of the device showing a closure member thereof closeably engaging both a primary holder and a secondary holder.
Figure 3:
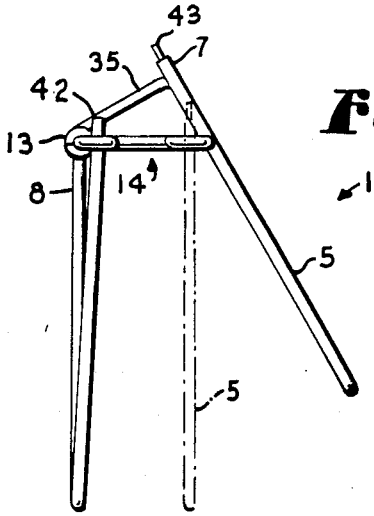
FIG. 3 is a side elevational view of the device in a partially open position, showing in phantom portions of the device in the closed position.

In the closed position shown in FIGS. 1 and 2, articles 19 are normally positioned on just loop 15 so as to fill the U-shaped portion 20 as well as partially up opposite legs 21 and 22 of the loop 15.

The secondary holder loop 15 at a hinged support end 24 thereof opposite the connecting end 10 is integrally attached to a hinged support shaft 25 that is in turn integrally attached to the closure member 14 such as a continuous single strand or wire. The shaft 25, when in the closed position, extends between the ends 10 and 24 of the loop 16 and is attached to the loop leg 22 at angle of approximately ninety degrees. The shaft 25 is also attached to the closure member at an angle of approximately ninety degrees such that the closure member extends between the end 10 of loop 16 and the end 7 of loop 15, when in the closed position. The closure member 14 includes a connecting intermediate portion 28 with a pair of semicircular of C-shaped segments 29 and 39 attached to opposite ends of the intermediate portion 28. The segment 29 is positioned to interferingly cradle the end 7 of the loop 15 and the segment 30 likewise cradles the end 10 of loop 16 when in the closed position. Also when in the closed position the segments 29 and 30 face opposite ends of the loops 15 and 16 respectively. The loops 15 and 16 of the device 1 are made of material resilient in nature so that, the loop ends 7 and 10 are braced against the segments 7 and 10 respectively when in the closed position, thereby firmly holding the device 1 in the closed position.

The primary holder 5 has fixedly attached thereto a hinge mechanism 13 although it is foreseen that the hinge mechanism may be embodied in different structures not fixedly attached to the holder 5. In particular, the holder 5 includes a continuous bend 33 at an end 34 of loop 15 opposite end 7. Extending from the bend 33 at an angle of approximately ninety degrees toward loop 16 is an integral intermediate leg 35. The hinge mechanism 13 comprises an integral and spiral extension 37 of leg 35 spirally wrapped around the hinge support shaft 25 of the secondary holder 8, intermediate end 24 and C-shaped segment 30. The hinge mechanism spiral extension is preferably sufficiently loose relative to the hinge support shaft 25 to allow relative rotation thereof by application of manual pressure by a user yet tight enough to interferingly resist rotation when manual pressure is not being applied thereto. The length of the intermediate leg 35 is approximately the same length as the closure member 14. When the primary holder 5 and the secondary holder 8 are secured in a closed position by closure member 14, intermediate leg 35 and the closure member intermediate portion 28 are generally parallel.

The ends 7 and 10 of the loops 15 and 16 respectively include joining means such as pin and socket joining mechanism 38 to allow the two end 7 and 10 to be coaxially joined so that leg 21 of loop 15 and a leg 39 of loop 16 are coaxially and relatively smoothly joined. In the present embodiment the joining mechanism 39 comprises peg receiving socket 42 on the loop end 10 and a peg 43 that are interferingly joinable. It is foreseen that other structures may be used for joining means.

In use, the primary holder 5, is disconnected from the closure member 14, near end 7, by manually pushing leg 21 toward leg 22 and to the front, as seen in FIG. 1. Articles 19 are then placed on the primary holder by inserting end 7 through the articles 19. The articles 19 may be secured and stored on the holder by reconnecting the primary holder 5 to the closure member 14, near the end 7. The device 1 is easily stored by hanging the device from the hinge mechanism 13. The device 1 may also be straddled on a beam or worn on the belt (not shown) of a user by slipping the secondary holder 8 behind the beam or belt and resting the closure member intermediate portion 28 and the leg 35 on top of such a beam or belt.

Figure 4:
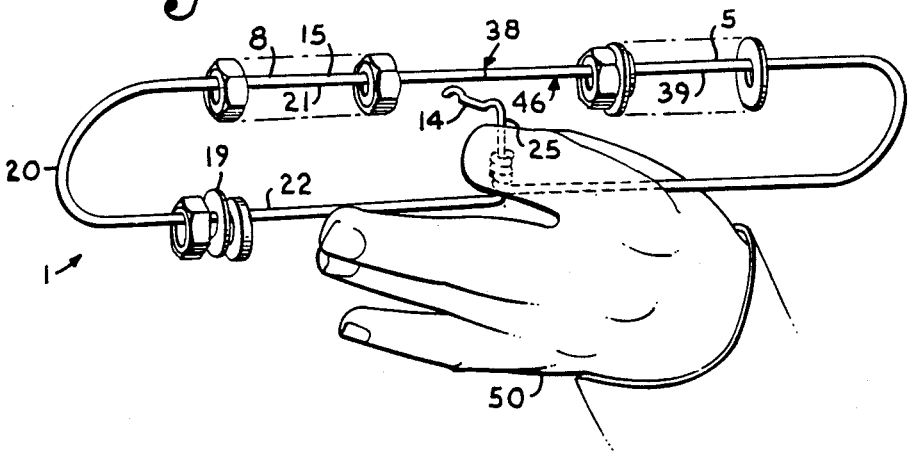
FIG. 4 is a perspective view of the device in a selection position and held by a hand of a user wherein the primary holder is connected to the secondary holder to select an article illustrating the use of the device to move articles from the primary holder to the secondary holder for selection and removal.

A user who wishes to select and remove a particular article 19 from the device 1 first disconnects the leg 21 of the primary holder 5 and the leg 39 of the secondary holder 8 from the closure member C-shaped segments 29 and 30 respectively and then rotates the primary holder 5 to the selection position, as shown in FIG. 4. The primary holder 5, is then connected to the secondary holder 8, by inserting the peg 43 into the socket 42 with legs 21 and 39 coaxially aligned to form a single closed pathway 45 between the primary holder 5 and secondary holder 8 to form a generally ovate or elliptically shaped structure between the loops 15 and 16. The diameter of the peg 43 is preferably sized to fit snugly into the socket 42. Preferably the users hand 50 is positioned so that the base of the hand support loop 15 and at least one finger of the hand 50 supports the loop 16 while the index finger wraps about the hinge support shaft 25 during the selection process so as to insure that the joining mechanism 38 remains joined together.

The user may then transfer articles 19 from the primary holder 5 over the joining mechanism 38, onto the secondary holder 8. When a desired article is reached, the user disconnects the primary holder 5 from the secondary holder 8 at the joining mechanism 38 and removes the article. The primary holder 5 and the secondary holder 8 may then be reconnected at the joining mechanism 38 and the non-selected articles now on leg 39 are slid therealong are returned to the primary holder 5 without ever completely removing the non-selected articles from the device 1. The primary holder 5 and the secondary holder 8 may then be returned to the position shown in FIG. 1 for storage or transport.

It is to be understood that while certain forms of the present invention have been illustrated and described herein, it is not to be limited to the specific forms or arrangement of parts described and shown.

What is claimed and desired to be secured by Letters Patent is as follows:

1. A device for storing and allowing selection of a particular article from a plurality of articles strung thereon, said device comprising:

(a) primary holding means, having a first elongate member adapted to extend through an aperture in each of the articles being held by said device;

(b) secondary holding means having a second elongate member connected to said primary holding means; said primary and secondary holding means having a storage position, and a selection position relative to one another; and (c) said primary and secondary holding means being alignable when in said selection position such that said first and second elongate members are connected end to end to allow the articles to be moved between said first and second members without removing the articles from the device and said first and second elongate members are separable such that a preselected one of said articles may be removed from said device and thereafter said first and second members are reconnectable; and further said primary and secondary holding means are alignable in the storage position wherein said first and second elongate members are not aligned end to end.

2. The device according to claim 1 wherein:

(a) said first and second elongate members are alignable in a generally side-by-side relationship when in said storage position.

3. The device according to claim 1 including:

(a) joining members for selectively joining said elongate members together in end to end relationship.

4. The device according to claim 3 wherein:

(a) said joining means comprise a pin and socket mechanism.

5. The device according to claim 1 wherein:

(a) each of said first and second elongate members includes elongate U-shaped loops.

6. The device according to claim 5 including:

(a) hinge means hingeably connecting said first and second elongate members.

7. The device according to claim 1 including:

(a) closure means for operably securing said first and second members in the storage position thereof and preventing removal of articles from said device when in the storage position.

8. The device according to claim 7 wherein:

(a) said closure means includes an elongate portion operably connected to said secondary holding means and having a segment operably surrounding and securing an end of said first elongate member when in said storage position.

9. A device for storing and allowing selection of a particular article from a plurality of articles strung thereon, said device comprising:

(a) primary holding means, having a first elongate member adapted to extend through an aperture in each of the articles being held by said device;

(b) secondary holding means having a second elongate member connected to said primary holding means; said primary and secondary holding means having a storage position, and a selection position relative to one another;

(c) said primary and secondary holding means being alignable when in said selection position such that said first and second elongate members are connected end to end to allow the articles to be moved between said first and second members without removing the articles from the device and said first and second elongate members are separable such that a preselected one of said articles may be removed from said device and thereafter said first and second members are reconnectable; and further said primary and secondary holding means are alignable in the storage position wherein said first and second elongate members are not aligned end to end; and (d) closure means comprising a closure member operably closing a free end of said first elongate member and preventing removal of articles from said first elongate member when in the storage position thereof and further allowing transfer of articles from said first elongate member when in the selection position thereof.

10. The device according to claim 9 wherein:

(a) said closure member is integral with said secondary holding means.

11. The device according to claim 9 including:

(a) joining means for joining said primary and secondary holding means together in end-to-end relationship when in the storage position thereof.

12. The device according to claim 9 wherein:

(a) said primary holding means is rotatably connected to said secondary holding means by a hinge mechanism such that when said primary holding means and secondary holding means are rotated from the storage position, same are operably aligned toward said selection position by said hinge mechanism.

13. The device according to claim 9 wherein:

(a) said primary holding means are constructed from a first wire into a resilient U-shaped loop;

(b) said secondary holding means and said closure member are constructed from a second wire into a resilient U-shaped loop having said closure member integrally attached thereto;

(c) said hinge mechanism comprises said first wire wrapped around said second wire to allow relative rotation therebetween.

14. A device for storing and allowing selection of a selected article from a plurality of articles strung on said device without removing non-selected articles from said device; said device comprising:

(a) primary holding means constructed of a flexible and resilient elongate first wire; said first wire having a first connectable end and an attached end; said first wire having an intermediate first U-shaped loop;

(b) secondary holding means connected to said primary holding means; said primary and secondary holding means having a storage position and a selection position relative to one another;

(c) said secondary holding means constructed of a flexible and resilient elongate second wire, said second wire having an intermediate second U-shaped loop; said second wire having a second connectable end and a closure member opposite said second connectable end thereof; said attached end of said first wire being partially wrapped around said second wire so as to provide a pivotal hinge therebetween;

(d) said first and second connectable ends including joining means for selectively joining relationship at said connectable ends;

(e) said primary and secondary holding means being selectively alignable so that, when said primary and secondary holding means are in said storage position, said first and second loops are in spaced but generally parallel relationship to one another; and further when in such storage position said first loop being held in position relative to said second loop by said closure member and said hinge so as to prevent the transfer of articles from said primary holding means to said secondary holding means;

(f) said primary and secondary holding means also being selectably alignable such that, when said primary and secondary holding means are in selection position, said joining means operably joins said connectable ends of said first and second loops such that said first and second loops are coaxially aligned at said joining means and such that articles may be slideably transferred between said first and second loops; and (g) said joining means being disconnectable such that a selected article located at said joining means can be removed from said device without removing the remaining non-selected articles from said device and thereafter said device can be returned to the selection position thereof such the non-selected articles can again be moved between said first and second loops.

* * * * *